United States Patent [19]

Jensen

[11] 4,420,004

[45] Dec. 13, 1983

[54] APPARATUS FOR USE IN CLEANING OF SILK SCREEN PRINTING FRAMES

[76] Inventor: Sverre Jensen, Bruveien 9, Stavanger, Norway, N-4000

[21] Appl. No.: 322,976

[22] Filed: Nov. 19, 1981

[30] Foreign Application Priority Data

Nov. 27, 1980 [NO] Norway ..... 803583

[51] Int. Cl.[3] ..... B08B 3/02

[52] U.S. Cl. ..... 134/96; 134/122 R; 134/200

[58] Field of Search ..... 134/94–96, 134/99, 113, 114, 122 R, 133, 144, 172–174, 200

[56] References Cited

U.S. PATENT DOCUMENTS

| | | | |
|---|---|---|---|
| 3,010,461 | 11/1961 | Faust et al. | 134/174 X |
| 3,459,201 | 8/1969 | Wache et al. | 134/96 |
| 3,580,261 | 5/1971 | Key | 134/200 X |
| 3,656,493 | 4/1972 | Black et al. | 134/172 X |
| 3,760,824 | 9/1973 | Edwards et al. | 134/144 |

FOREIGN PATENT DOCUMENTS 2339906 2/1975 Fed. Rep. of Germany .

*Primary Examiner*—Robert L. Bleutge

*Attorney, Agent, or Firm*—Schwartz, Jeffery, Schwaab, Mack, Blumenthal & Koch

[57] ABSTRACT

An apparatus for automatic cleaning of silk screen printing frames, comprising a chamber (1), a vertical nozzle holder (4) being adapted to move in a horizontal direction throughout the entire width of said chamber (1) and a plurality of nozzles (5) arranged in separate groups and serving to spray a variety of liquids, being pumped from reservoirs (6, 7, 8) associated with said chamber (1), successively onto said frame (2). The reservoirs 6 and 7 are provided with rotating lids 9, 10 repectively which can assume overlapping positions to prevent the flow of return fluid into the reservoirs or generally upright positions to direct the flow of return liquid into the respective reservoir.

3 Claims, 2 Drawing Figures

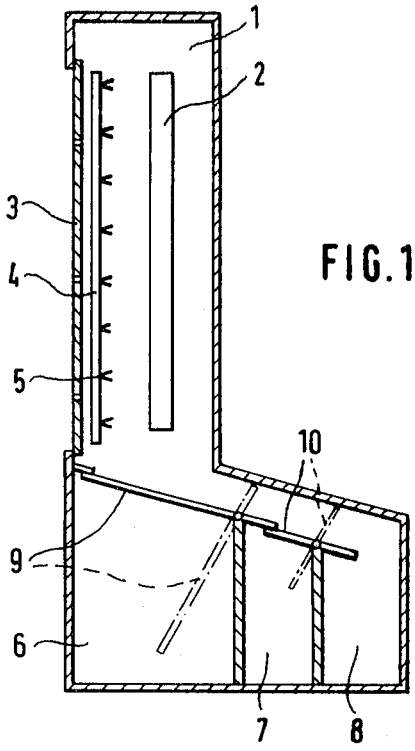
FIG.1
FIG.2
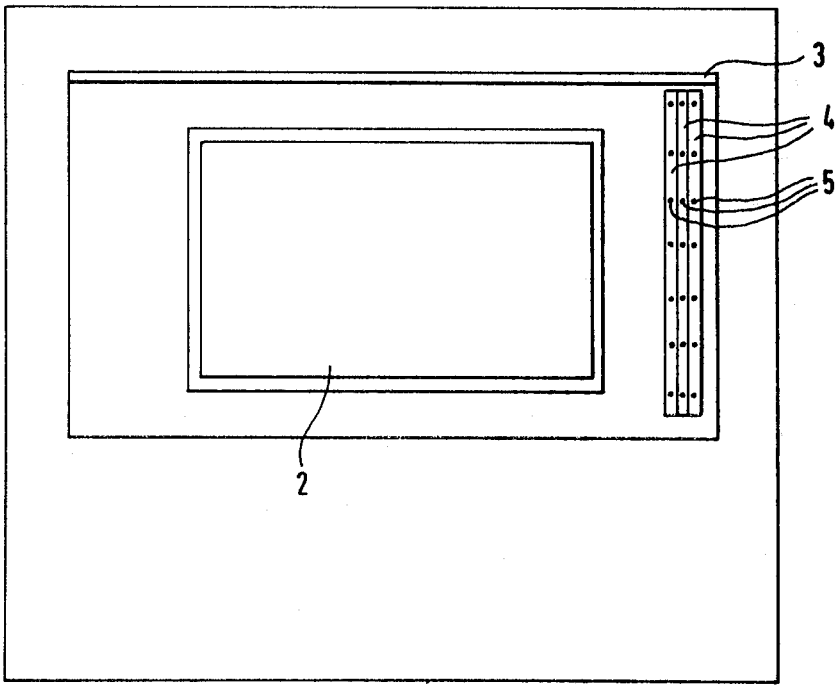

APPARATUS FOR USE IN CLEANING OF SILK SCREEN PRINTING FRAMES

BACKGROUND OF THE INVENTION

1. Field of the Invention

The present invention relates to an apparatus for use in cleaning of silk screen printing frames.

2. Description of the Relevant Art

Cleaning of silk screen printing frames is usually accomplished by washing the dye from the frame, using rags and strong solvents. After the removal of the dye by means of said solvents, the printing stencil is removed, using a high pressure water jet.

Inhalation of vapors from solvents which are used for cleaning of silk screen printing frames may prove highly injurious to health, and this is the reason why the authorities in an ever increasing number of countries will not allow the use of the above-mentioned method for cleaning of silk screen printing frames.

Machines have been provided which are capable of removing the dye from such frames, and the printing stencil may be removed from the frames by using other machines of the prior art. However, in such case the operator will be dependent on two different machines, and it is thereby necessary during the cleaning operation to dismantle the frame from the first machine, after removal of the dye, and place the frame into the second machine, for deletion of the stencil. Removal of the frame out of the first machine causes emission of solvent vapors in large quantities.

OBJECTS AND SUMMARY OF THE INVENTION

It is therefore an object of the present invention to provide an apparatus for automatic removal of dye and printing stencil from silk screen printing frames wherein, during use, the operators are not subjected to inhalation of solvent vapors.

According to the invention, this is achieved by placing the frame to be cleaned in a closeable chamber. The chamber includes means for accomodating said frame, and nozles for spraying liquids onto the frame are positioned inside the chamber. A plurality of nozzles, arranged in separate groups, are mounted longitudinally on vertical nozzle holder, which is able to move by means already in a horizontal direction across the entire width of the chamber. The nozzles spray a variety of liquids, pumped from reservoirs associated with said chamber, successively onto the frame; the spent liquids are returned to the respective reservoirs.

In a further embodiment of the present invention, one or more of the reservoirs in association with the chamber are provided with levered lids which may be opened and closed individually, the lids being arranged in positions overlapping each other in a way permitting return liquids to flow over one or more lids and to be led back to the respective reservoirs.

According to a still further embodiment of the invention, the end walls of the chamber are provided with slots, whereby silk screen printing frames, having a width exceeding that of the apparatus, may be inserted through said slots into the chamber.

BRIEF DESCRIPTION OF THE DRAWING

The invention may be better understood with reference to the accompanying drawings wherein:

FIG. 1 is a vertical cross sectional view showing an apparatus according to the present invention, as seen from one side, and FIG. 2 is front view showing the apparatus of FIG. 1.

Referring to the drawing, a chamber 1, having placed therein a silk screen printing frame 2 for cleaning is provided with a door 3 and a vertical nozzle holder 4. Nozzle holder 4 is adapted to move in a horizontal direction throughout the entire width of the chamber, using operational means well-known to a person skilled in the art. A plurality of nozzles 5 arranged in separate and parallel groups are connected to the nozzle holder 4. Nozzles 5 are adapted to spray liquids, being pumped from the reservoirs 6, 7 and 8, successively onto the frame 2. The reservoirs 6, 7 and 8 are entirely or partly covered by lids 9 and 10.

The apparatus according to the present invention operates as follows:

A silk screen printing frame 2 is inserted through door 3 in the chamber 1. On closing the door 3, a fan, not shown, is actuated automaticly to establish a negative pressure within the chamber 1. Simultaneously, nozzle holder 4 starts a reciprocating and continuous motion in the chamber 1, and a pump, not shown, is actuated, thereby causing solvent from the reservoir 7 to be sprayed onto frame 2 through the nozzles 5. During pumping of solvent from reservoir 7, container 6 is covered by lid 9 and lid 10 is turned into a slanting position, so that the spent liquid, after passing through nozzles 5 and frame 2, flows back to the container 7.

When dye in the frame 2 has been removed by means of solvents, frame 2 may be sprayed with chemicals from a reservoir 8 through another group of nozzles 5, in order to delete the stencil inside the frame. Lids 9 and 10 are turned into positions wherein they cover reservoirs 6 and 7, so that spent chemicals, having passed through the nozzles 5 and the frame 2, can flow downward into reservoir 8.

The stencil inside frame 2 may even be removed by flushing the frame 2 with hot water from the reservoirs 6. During this operation, lid 9 is turned into a slanting position permitting a flow of the spent water back into reservoir 6, or to an outlet, after having passed through the nozzles 5 and the frame 2.

In case the frame 2 should prove to be too long, it may be transferred through th apparatus via slots, not shown, in the end walls of the chamber 1. Such slots may be formed of a resilient material, for instance rubber, to prevent escaping of solvent vapors from chamber 1.

Use of the apparatus according to the present invention will permit removal of the dye, as well as the printing stencil, in a single machine. The frame 2, being flushed with water before leaving the chamber 1, will cause no emission of solvent vapors on removal. Thus, the frame 2 is completely odorless, and the operator will not be subjected to inhalation of solvent vapors, injurious to health.

The apparatus is operated in a very easy way and, because of the returning of the spent cleaning compounds to their respective reservoirs 6, 7 and 8, it will also allow saving of resources.

I claim:

1. A silk screen printing frame cleaning apparatus comprising:

a closeable chamber in which a silk screen printing frame is adapted to be held;

a plurality of liquid applying means mounted in said chamber and movable with respect to said frame;

a plurality of means for containing liquids to be applied by said liquid applying means to the frame;

means for conveying the liquids from one of said containing means to an associated one of said plurality of applying means;

means for returning applied liquid to the containing means from which said applied liquid was conveyed;

said plurality of liquid containing means being disposed below said chamber and formed by walls of said apparatus in cooperation with a series of partitions of decreasing height, each of said liquid containing means having a substantially planar lid having an upper and lower end, each of said lids being pivotally attached intermediate said upper and lower ends and adjacent to an upper edge of one of said partitions, the lower end of each of said lids overlapping an adjacent lid, said closed lids forming a downwardly sloping surface whereby the liquids flow down said sloping surface and into a containing means whose associated lid is open.

2. The apparatus of claim 1, wherein each of said liquid applying means has a plurality of liquid applying nozzles for directing liquid at substantially the entire frame.

3. The apparatus of claims 1 or 2, wherein said liquid containing means substantially extends the width of said chamber.

* * * * *